US008143975B2

(12) United States Patent
Perndl et al.

(10) Patent No.: US 8,143,975 B2
(45) Date of Patent: Mar. 27, 2012

(54) COAXIAL-COPLANAR MICROWAVE ADAPTER

(75) Inventors: Werner Perndl, Vaterstetten (DE); Thomas Reichel, Baldham (DE); Markus Leipold, Isen (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 294 days.

(21) Appl. No.: 12/515,532

(22) PCT Filed: Nov. 5, 2007

(86) PCT No.: PCT/EP2007/009574

§ 371 (c)(1),
(2), (4) Date: Dec. 8, 2009

(87) PCT Pub. No.: WO2008/016123

PCT Pub. Date: May 29, 2008

(65) Prior Publication Data

US 2010/0141361 A1 Jun. 10, 2010

(30) Foreign Application Priority Data

Nov. 22, 2006 (DE) ..... 10 2006 055 162
Mar. 23, 2007 (DE) ..... 10 2007 013 968

(51) Int. Cl.
*H01P 1/04* (2006.01)

(52) U.S. Cl. ..... 333/260; 333/33

(58) Field of Classification Search ..... 333/33, 333/34, 25, 26, 260; 439/63, 581
See application file for complete search history.

(56) References Cited

U.S. PATENT DOCUMENTS

| | | | | |
|---|---|---|---|---|
| 5,404,117 | A | 4/1995 | Walz | |
| 5,570,068 | A | 10/1996 | Quan | |
| 5,897,384 | A | 4/1999 | Hosler | |
| 6,774,742 | B1 | 8/2004 | Fleury | |
| 2003/0020560 | A1 * | 1/2003 | Marsh | 333/33 |
| 2003/0099098 | A1 | 5/2003 | Schutt-Aine | |
| 2004/0038587 | A1 | 2/2004 | Yeung | |

FOREIGN PATENT DOCUMENTS

| | | |
|---|---|---|
| DE | 2002866 | 7/1971 |
| DE | 103 13 590 A1 | 10/2004 |

OTHER PUBLICATIONS

Levy, R., "New Coaxial-to-Stripline Transformers Using Rectangular Lines," IRE Transactions on Microwave Theory and Techniques 9(3):273-274, May 1961.

Nhan, E., et al., "Radio-Frequency Connector and Interconnect Reliability in Spaceborne Applications," IEEE Transactions on Components, Packaging and Manufacturing Technology, Part A 18(1):163-168, Mar. 1995.

* cited by examiner

*Primary Examiner* — Stephen Jones
(74) *Attorney, Agent, or Firm* — Christensen O'Connor Johnson Kindness PLLC

(57) ABSTRACT

In a microwave transition from a coaxial line (1) to a coplanar line system (3), in a longitudinal hole (5) of an outer conductor housing (6), the round inner conductor (4) of the coaxial line (1) continues in a planar inner conductor in the form of a narrow piece of foil (9), of an elastically flexible insulating material and metalized on at least one side. The end of this planar inner conductor (9, 10) then narrows in a transition section (16) to the width of a coplanar middle conductor (13; 20), with coplanar earthing areas (14, 15; 21, 22) on both sides.

21 Claims, 4 Drawing Sheets

COAXIAL-COPLANAR MICROWAVE ADAPTER

Figure 1:
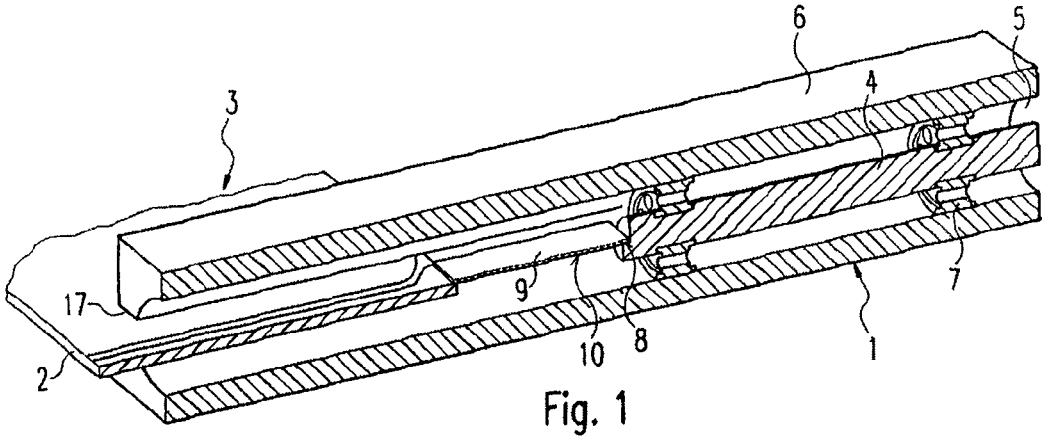

The invention concerns a microwave transition from a coaxial line to a coplanar line system.

Today, microwave circuits are often in the form of planar waveguide technology. To connect these integrated microwave circuits to other functional units and devices, there must be a transition back to coaxial lines. For this purpose, appropriate microwave transitions are necessary, and for many applications must be very broadband and have the lowest possible reflection and passband attenuation.

The transitions which have been common until now achieve this only very inadequately. The use of a sleeve-like contact shoe, which is plugged onto the inner conductor of the coaxial line and connected via a projection to the middle conductor of the coplanar line system (e.g. according to DE 103 13 590 A1 or U.S. Pat. No. 6,774,742 B1) results in an abrupt transition of the field image, and therefore in strong reflections and/or bad suitability for broadband applications. Also, the coaxial line is badly decoupled mechanically and thermally from the coplanar line system. The same applies to known solutions in which the inner conductor of the coaxial line is strongly tapered and put directly onto the middle conductor of the coplanar line system (e.g. U.S. Pat. Nos. 5,570,068 or 5,897,384).

It is the object of the invention to create a broadband microwave transition of the above-mentioned kind, which is optimal in relation to both reflection and attenuation, and above all ensures good mechanical and thermal decoupling between the coaxial line and the coplanar line system.

This object is achieved through the features of claim 1. Advantageous further developments are given in the subclaims.

According to the invention, the connection between the inner conductor of the coaxial line and the middle conductor of the coplanar line system is made via a piece of foil, which is metallised on one or both sides and of an elastic insulating material. A coaxial line system with planar inner conductor is connected to the round inner conductor of the coaxial line, and is followed by a transition section to the coplanar line system. In this way a continuous transition of the coaxial field into a coplanar field image is achieved, and thus a reflection-free connection of a coplanar line system to a coaxial line, from which the connection to other microwave devices can be produced via suitable coaxial plugs and coaxial cables.

Also, because of the elastic properties of the metallised foil, good mechanical decoupling between the coaxial inner conductor and the coplanar line system is ensured, as is good thermal decoupling, above all if, as a further development of the invention, the actual transition section between coaxial system with planar inner conductor and coplanar line system is also formed directly on the metallised foil, and the edges of the foil in this transition region are fixed directly to the outer conductor housing. In this case, heat can flow via the planar inner conductor to the outer conductor, and heating of the coplanar line system is avoided.

A transition according to the invention can also be produced very inexpensively, it has small production tolerances, the metallisation on the foil can be applied in the desired form by photolithographic methods, and the contours of the plastic foil can be produced very precisely by laser cutting. It is also possible to compensate through the flexible foil for any height tolerances of the mechanical components which are connected to each other.

The invention is explained in more detail below on the basis of schematic drawings of embodiments.

Figure 2:
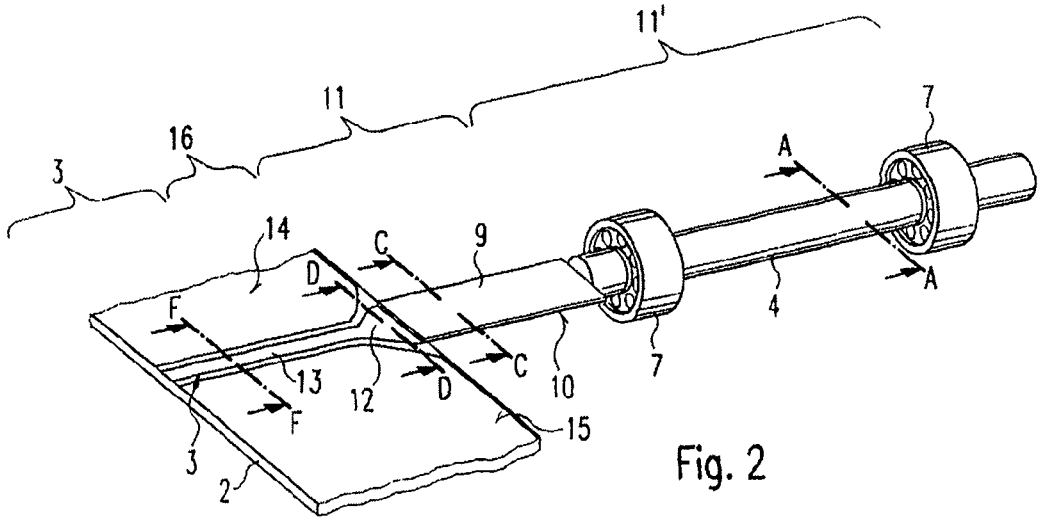
Figure 3:
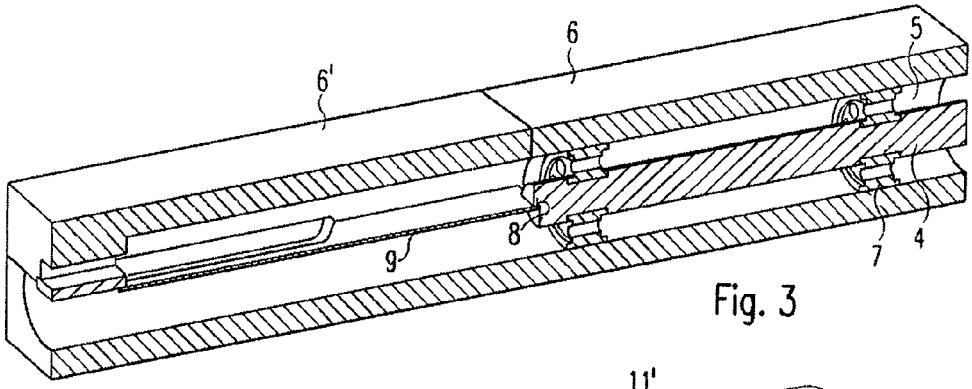
Figure 4:
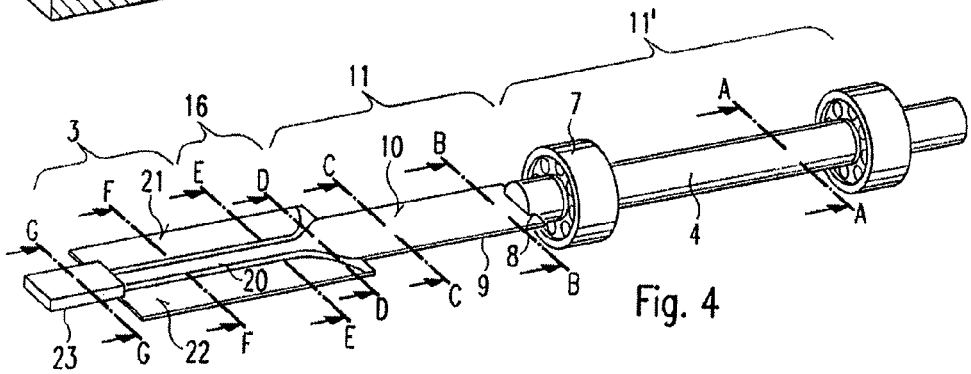
Figure 5:
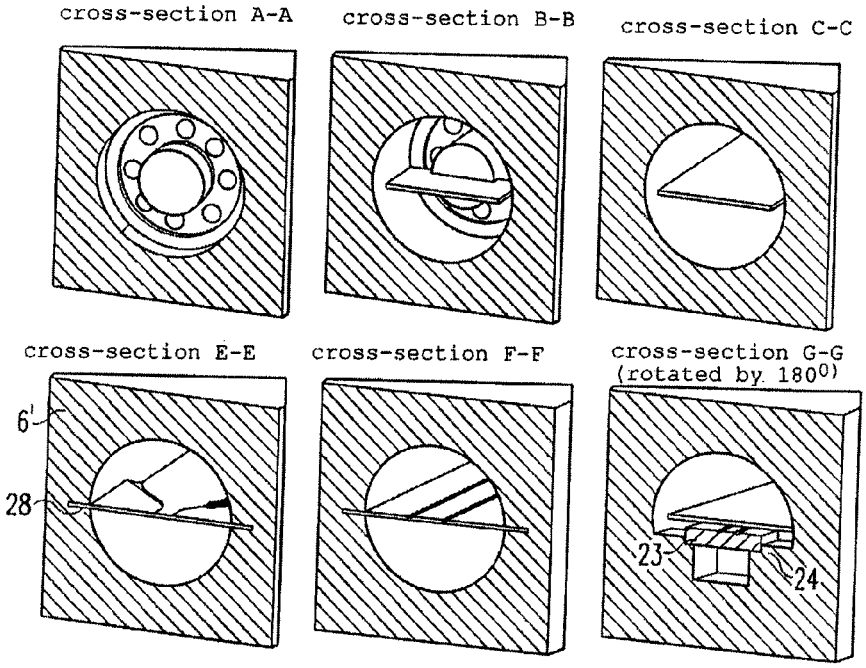
Figure 6:
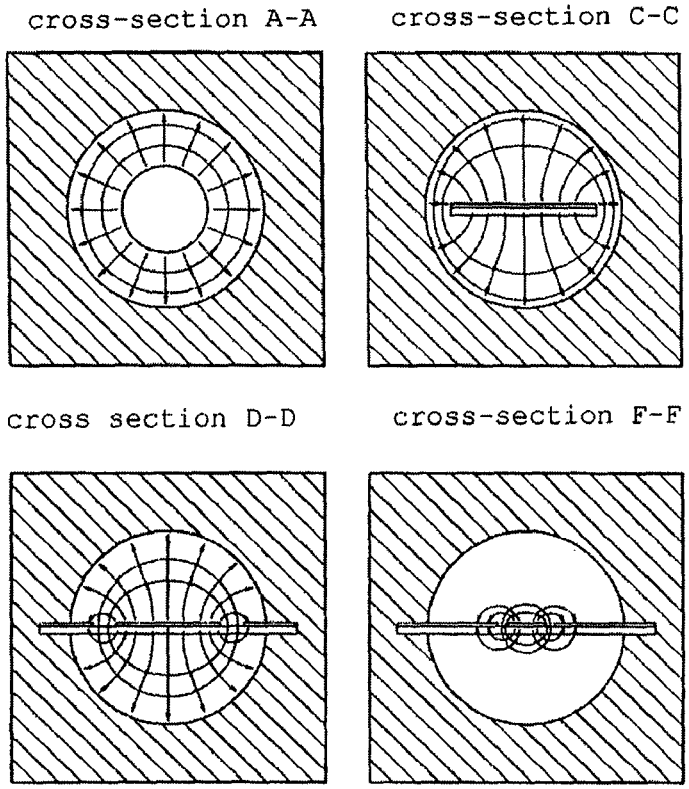
Figure 7:
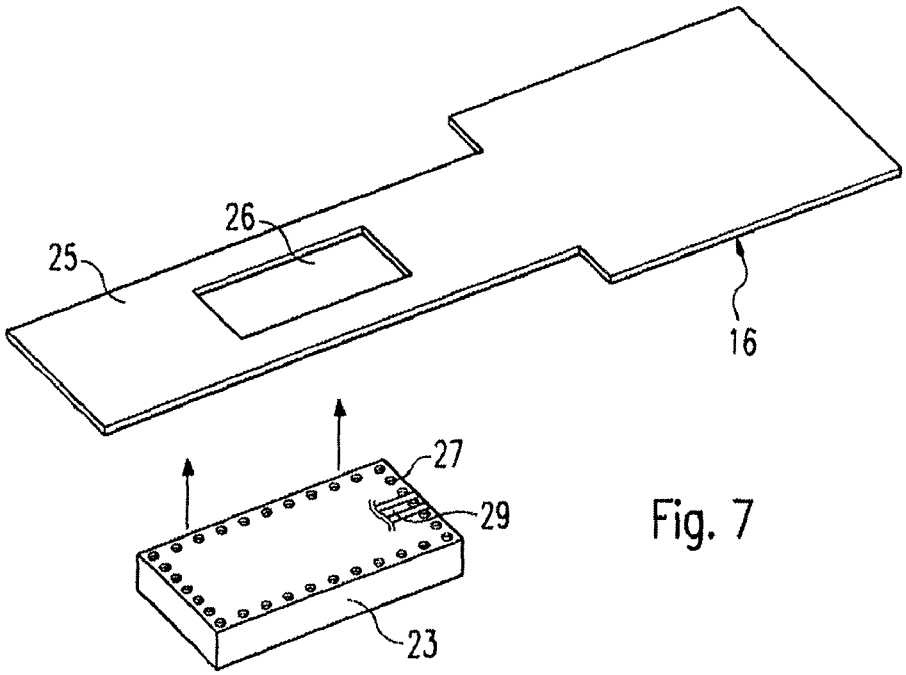
Figure 8:
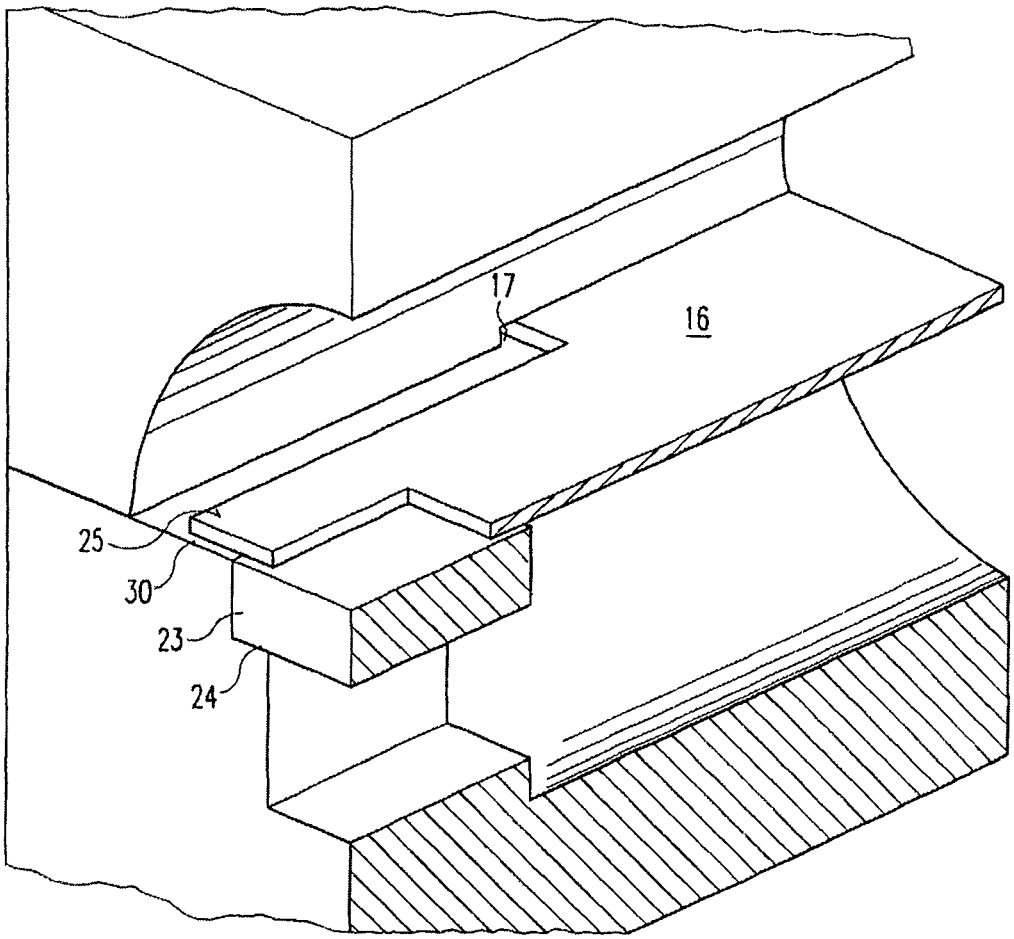

FIG. 1 shows the longitudinal cross-section of a microwave transition according to the invention at the transition from a coaxial line to a coplanar line system of a relatively large substrate, FIG. 2 shows the associated inner conductor construction, FIG. 3 shows a longitudinal cross-section of a further embodiment, in which the transition from planar inner conductor to coplanar line system takes place directly on the piece of foil, FIG. 4 shows the inner conductor construction associated with FIG. 3, FIG. 5 shows various cross-sections of FIGS. 2 and 4, FIG. 6 shows the electrical field images associated with these cross-sections according to FIGS. 2 and 4, FIG. 7 shows the direct fixing of a small microwave chip on the foil shown in FIGS. 3 and 4, and FIG. 8 finally, shows the type of fitting for optimal heat dissipation from this chip according to FIG. 7 to the surrounding outer conductor housing.

FIG. 1 shows the longitudinal cross-section of a first embodiment of a microwave transition between a coaxial line 1 and a coplanar line system which is formed on the upper side of a substrate 2. The inner conductor 4, which is round in cross-section, of the coaxial line 1 is fixed by insulating supports 7 concentrically and both axially and transversely in a longitudinal hole 5, which is round in cross-section, of an outer conductor housing 6. The supports 7, in a way which is known per se, are designed so that the additional capacitances which occur because of the built-in dielectric of the supports are compensated for by corresponding inductances on the inner conductor, achieved by reducing the inner conductor diameter.

The dimensions of the coaxial line 1 are chosen so that a line surge impedance of, for instance, 50 Ω results, and the limit frequency of the first higher mode is greater than the maximum operating frequency. At the outer end of this coaxial line piece 1, a coaxial line connection (not shown) for an (e.g. flexible) coaxial line can be provided.

At the inner end of the round inner conductor 4, it is flattened on one side as far as the middle, and on this flattened part 8 of the round inner conductor 4 a short piece of foil 9 of an elastic insulating material, e.g. polyimide, is placed, and on its underside facing the flattened part 8 is coated with a thin gold layer 10. The width of this planar inner conductor 9 of the coaxial line section 11 within the hole 5 is chosen so that the fundamental mode again gives a line surge impedance of, for instance, 50 Ω. The axial length of the flattened part 8 determines the field compensation in this region. In the embodiment according to FIGS. 1 and 2, the transition from the planar inner conductor 9 of the coaxial line system 11 to the coplanar line system 3 takes place directly via a coplanar transition section 16 on the upper side of the substrate 2. Another possibility for fixing the piece of foil 9 consists, for instance, of providing the inner conductor at the end with a slit, into which the piece of foil is inserted.

The transition section 16 which is formed on the substrate 2 in FIGS. 1 and 2 consists of a middle conductor section 12, which tapers in suitable form, e.g. S-shaped, trapezoidal or stepped, from the width of the planar inner conductor 9 to the width of the middle conductor 13 of the coplanar line system 3, which is formed on the substrate 2. On the wider end of this middle conductor section 12, the end of the metal layer 10, which is deposited on the underside of the piece of foil 9, is placed and thus electrically connected. On both sides of this tapering middle conductor section 12, earthing areas 14, 15 of the coplanar line system, also in suitable form, e.g. again S-shaped, trapezoidal or stepped, are put onto this middle conductor section 12, so that between the middle conductor section 12 and these earthing areas 14, 15, the result is gaps which gradually taper in width like funnels, and finally become narrow gaps between the middle conductor 13 and the lateral earthing areas 14, 15 of the coplanar line system 3. The precise shape of the middle conductor section 12 and of the earthing areas 14, 15, which are put on from outside, must be specially optimised depending on the application.

The piece of foil, which is metallised on the underside, is fixed on the flattened part 8, or on the substrate 2 at the overlap with the middle conductor section 12, for instance by welding or gluing. Preferably, on the metallised side 10 of the foil 9, corresponding metal bumps are provided, and through them, by a thermocompression method, a mechanical and electrical connection between the metallised back 10 of the foil and the flattened part of the inner conductor 8 or the transition section 12 is produced.

The electrical and magnetic field lines which are shown in the cross-sections A-A, C-C, D-D and F-F according to FIG. 6 show that the coaxial field image from cross-section A-A is only slightly deformed at the transition to cross-section C-C. Similarly, at the transition from cross-section C-C to cross-section D-D, only a slight change of the field image occurs. At the transition to cross-section F-F, the field becomes increasingly concentrated around the middle conductor 12 of the coplanar line system 3. This transition represents only a slight disturbance, so that in total a very low-reflection transition from a coaxial field into a coplanar field is given.

In the example according to FIG. 1, the substrate 2 is pushed into a slit 17 of the housing 6, so that the outer conductor of the coaxial line system 11', 11 continues beyond the transition region 16. The upper and lower outer conductor housing sections, which are separated by the substrate 2 and slit 17, must be connected to each other electrically, at least in the region of the transition section 16, by corresponding plated-through holes in the substrate, so that in the transition region 16 the outer conductor remains closed, which is necessary for a continuous field transition.

FIGS. 3 to 5 show a further embodiment of the invention, in which the actual transition region 16 between planar inner conductor 9, 10 and coplanar line system 3 is formed on an extension of the foil 9. For clarity, the representations of FIGS. 3 and 4 are rotated by 180° around the longitudinal axis compared with those according to FIGS. 1 and 2. The narrow piece of foil 9 with its metal coating 10, which in this case is deposited on the upper side, expands in the region 16 to more than the internal diameter of the outer conductor hole 5, and the edges of this expanded piece of foil are inserted into longitudinal slits 28 of the outer conductor housing 6, as cross-section E-E according to FIG. 5 shows. For easier fitting of the foil in these lateral slits 28, for instance the upper part 6' of the housing 6 is removable, and in this case the slits are formed by corresponding longitudinal grooves.

The metal coating 10 on the upper side of the foil 9 makes electrical contact with the outer conductor housing 6 in these longitudinal slits. The planar inner conductor 9, 10 narrows in the transition region 16 from its original width to the width of the middle conductor 20. Simultaneously, on both sides of this narrowing of the planar inner conductor 9, 10 as far as the width of the middle conductor 20, the earthing areas 21 and 22 of the coplanar line system are placed correspondingly on the inner conductor. They are separated from the middle conductor 20 only by gaps, so that a coplanar line system 3 is given, preferably again with a line surge impedance of 50 Ω.

FIG. 5 shows the associated cross-section images along the cross-section lines shown in FIG. 4. In FIG. 6, it can be seen that starting from the coaxial line 1 (cross-section A-A) in transition to the planar inner conductor 10 (cross-section C-C), only a slight change of the field image occurs. The same is true at the transition from the planar inner conductor 10 to the transition section 16 (cross-section D-D), as far as the coplanar line system 3 on the foil (cross-section D-D). At the transition from cross-section D-D to cross-section F-F, the field is increasingly concentrated around the middle conductor 12 of the coplanar line system 3. This continuous transition from the coaxial field image into the coplanar field image ensures optimal electrical properties such as low reflection and attenuation. The use of an elastic foil also ensures good mechanical and thermal decoupling between the coaxial line and the coplanar line system, i.e. forces on the inner conductor of the coaxial line are not merely greatly damped when transmitted onto the planar structure, but practically completely avoided. Similarly, heating of the planar structure because of temperature differences between the coaxial inner conductor and the coplanar circuit are avoided, since because of the lateral fixing of the foil edges in the outer conductor housing (cross-section E-E in FIG. 5), heat is conducted away outward via the foil.

Additionally, in the embodiment according to FIGS. 3 to 5, a possibility for direct transition from a coaxial line 1 to a semiconductor chip 23, which has a corresponding coplanar line system on its upper side, is shown. The dimensions of the semiconductor chip 23 can be smaller or greater than the cross-section of the longitudinal hole 5 of the outer conductor housing 6. In the shown case, the chip 23 is built directly into the outer conductor housing 6, and connected to the middle conductor 20 of the transition section on the foil, as is shown by the cross-section G-G, rotated by 180°, in FIG. 5. The chip 23 is held mechanically on corresponding lateral projections 24 of the outer conductor housing 6, and its coplanar line sections are in turn connected, for instance again by bumps, to the coplanar line section 3.

FIGS. 7 and 8 show another possibility for direct fixing of such a semiconductor chip 23 within the outer conductor housing 6. The foil, which is greatly widened in the transition section 16, and the edges of which in this region are clamped in the outer conductor housing G (slits 17), continues in a foil section 25, which is not clamped in the housing 6, so that height tolerances of the components and/or thermal warping are compensated for. Directly above the fixing point of the chip 23 on the foil, the latter is provided with a recess 26, so that the tracks 29 running on the upper side of the chip 23 are exposed. On the periphery of the chip, a series of bumps 27 for a thermocompression connection to the foil is provided, and the chip, according to FIG. 7, is put onto the foil from below and fixed there via the bumps. On the side edges of the chip, the connection can be further strengthened by adhesive.

Finally, FIG. 8 shows in detail how such a chip 23, which is placed directly on the foil in this way, can be put into the surrounding housing 6 with as good heat dissipation to it as possible. The longitudinal cross-section shows firstly that the chip 23 rests directly on the housing via a step 24, and also that the foil 25, which carries the chip, rests on a step 30 of the housing over a wide area, so that via these surfaces, heat is conducted away outward to the housing from both the chip and the foil.

When the chip 23 is fixed on an extension 25 of the piece of foil, there is also the possibility of forming additional line structures, leading to the chip, on the upper side or underside of this piece of foil 25. These line structures can be used, for instance, for feeding low frequency signals to or from the chip, but they can equally well be used as high frequency line structures. It is thus conceivable, for instance, to form coplanar line structures, via which high frequency signals are fed to or from the chip 23, on the extended piece of foil 25. Obviously, this coplanar line system, which is connected directly to the chip 23, can itself be carried over into a coaxial line system, by transitions first from the chip 23 to a coplanar line system 3 as shown in FIG. 4, then in a transition section 16 to a planar coaxial line system 11, and finally from there, if required, back to a coaxial line. For this purpose, it is only necessary to extend the outer conductor housing 6 correspondingly beyond the extension section 25.

The figures each show greatly enlarged representations of the microwave transition according to the invention. For a microwave transition in the GHz range (e.g. 67 GHz), for instance the inner conductor 4 of the coaxial line 1 has a diameter of only 0.804 mm, the supports 7 an outer diameter of 1.85 mm, and the axial length of the coaxial line section 1, to the outside of which a coaxial coupling (not shown) is usually also attached, is in total only about 8 mm long, and likewise the actual foil section in FIG. 4. The foil preferably has a thickness of only about 50 μm, and the gold coating which in the embodiment is deposited on it on one side only, but can be deposited on both sides in some circumstances, only about 2 μm.

The invention claimed is:

1. A microwave connector for making a transition from a coaxial line (1) to a coplanar line system (3), comprising:

an outer conductor housing (6);

a round inner conductor (4) of the coaxial line (1) that continues into a planar inner conductor in the form of a narrow piece of foil (9), of an elastic insulating material and metallised on at least one side, and wherein an end of this planar inner conductor (9, 10) narrows in a subsequent transition section (16) to the width of a coplanar middle conductor (13; 20), and on both sides of the middle conductor section (12) of the transition section (16), earthing areas (14, 15; 21, 22) are put on.

2. The microwave connector according claim 1, characterized in that the piece of foil (9) consists of polyimide, kapton, LCP, Teflon-based foil or a comparable plastic, and is coated on at least one side with a gold layer (10).

3. The microwave connector according to claim 1, characterized in that the round inner conductor (4) of the coaxial line (1) is held by supporting discs (7) of insulating material in a longitudinal hole (5) of the outer conductor housing (6).

4. The microwave connector according to claim 1, characterized in that the transition section (16) is formed on a substrate (2), which has the coplanar line system (3).

5. The microwave connector according to claim 4, characterized in that the coplanar middle conductor (20) of the transition section (16) is connected to the middle conductor of the coplanar line system (3), and the earthing areas (14,15) of the coplanar line system (3) are connected to the outer conductor housing (6), by welding, gluing or a thermocompression method by means of bumps.

6. The microwave connector according to claim 1, characterized in that the planar inner conductor is fixed in electrical contact at an end of the round inner conductor (4) of the coaxial line.

7. The microwave connector according to claim 6, characterized in that the metal layer (10) of the foil (9) is connected to the inner conductor end by welding, gluing or a thermocompression method by means of bumps.

8. The microwave connector according to claim 1, characterized in that the transition section (16) is formed on a continuation of the piece of foil (9) which forms the planar inner conductor (9) and is metallised on at least one side.

9. The microwave connector according to claim 8, characterized in that the middle conductor section (12) of the transition section (16) and the earthing areas (14, 15; 21, 22) on both sides of the transition section (16) are structured so that between them a tapering gap exists.

10. The microwave connector according to claim 8 characterized in that the edges of the foil piece continuation on which the transition section (16) is formed are fitted in longitudinal slits (28)the outer conductor housing (6).

11. The microwave connector according to claim 1, further comprising:

a semiconductor chip (23)

arranged in the outer conductor housing (6), and placed with tracks of a coplanar line system on the middle conductor (20) and/or the earthing areas (21, 22) of the transition section (16), and fixed by welding, gluing or a thermocompression method by means of bumps.

12. The microwave connector according to claim 11, characterized in that the semiconductor chip (23) is held by its edges (24) in a longitudinal hole of the outer conductor housing (6).

13. The microwave connector according to claim 11, characterized in that the piece of foil (9) has a recess (26) in the region of the chip (23), and the semiconductor chip (23) is fixed to the metal surface of the foil only at its edges.

14. The microwave connector according to claim 11, characterized in that on the piece of foil (9, 25), additional line structures leading to the semiconductor chip (23) are formed.

15. The microwave connector according to claim 14, characterized in that the additional line structures are formed on a piece of foil (25) which is extended beyond the chip (23).

16. The microwave connector according to claim 15, characterized in that the additional line structures are at least partly coplanar line structures.

17. The microwave connector according to claim 16, characterized in that the additional line structures have transitions from coplanar line structures to coaxial line structures.

18. An electrical transition connector, comprising:

an outer housing;

an inner conductor supported by insulators within the outer housing;

a planar inner conductor having one end electrically connected to the inner conductor and another end electrically connected to a middle conductor section of a coplanar line system; and wherein the outer housing includes a slit surrounding a transition region where a width of an electrical path between the inner conductor and the middle conductor of the coplanar line system narrows, wherein the outer housing on each side of the slit is electrically connected.

19. The electrical transition connector of claim 18, wherein the transition region where the width of the electrical path narrows is in a substrate that supports the coplanar line system.

20. The electrical transition connector of claim 18, wherein the transition region where the width of the electrical path narrows is in the planar inner conductor.

21. The electrical transition connector of claim 18, wherein the planar inner conductor is made of a metal coated polyimide material.

* * * * *

UNITED STATES PATENT AND TRADEMARK OFFICE

CERTIFICATE OF CORRECTION

PATENT NO. : 8,143,975 B2
APPLICATION NO. : 12/515532
DATED : March 27, 2012
INVENTOR(S) : P. Perndl et al.

It is certified that error appears in the above-identified patent and that said Letters Patent is hereby corrected as shown below:

| COLUMN | LINE | ERROR |
|---|---|---|
| 6 | 7 | "the outer conductor" should read |
| (Claim 10, | line 5) | --of the outer conductor-- |

Signed and Sealed this
Fifteenth Day of January, 2013

David J. Kappos

David J. Kappos
*Director of the United States Patent and Trademark Office*